United States Patent [19]

Mitchell et al.

[11] Patent Number: 4,457,856

[45] Date of Patent: Jul. 3, 1984

[54] LIQUID DETERGENT COMPOSITION CONTAINS ABRASIVE PARTICLES, ANIONIC AND NONIONIC SURFACTANTS

[75] Inventors: Sharon J. Mitchell, West Chester; Jonathon Spinner, Cincinnati, both of Ohio

[73] Assignee: The Procter & Gamble Company, Cincinnati, Ohio

[21] Appl. No.: 485,755

[22] Filed: Apr. 21, 1983

Related U.S. Application Data

[63] Continuation of Ser. No. 291,867, Aug. 10, 1981, abandoned, which is a continuation of Ser. No. 110,148, Jan. 7, 1980, abandoned.

[51] Int. Cl.[3] ..... C11D 3/06; C11D 3/08

[52] U.S. Cl. ..... 252/166; 252/174.25; 252/550; 252/554; 252/544

[58] Field of Search ..... 252/160, 174.2 S, 550, 252/554, 544, 163, 166

[56] References Cited

U.S. PATENT DOCUMENTS

| | | | |
|---|---|---|---|
| 3,623,990 | 11/1971 | Cambre | 252/137 |
| 3,677,954 | 7/1972 | Nakajima | 252/121 |
| 3,813,349 | 5/1974 | Wolfson | 252/526 |
| 3,981,826 | 9/1976 | Munro | 252/526 |
| 4,051,056 | 9/1977 | Hartman | 252/99 |
| 4,302,347 | 11/1981 | Straw | 252/116 |

FOREIGN PATENT DOCUMENTS 1534680 12/1978 United Kingdom .

*Primary Examiner*—John D. Welsh

*Attorney, Agent, or Firm*—Donald E. Hasse; Edmund F. Gebhardt; Robert B. Aylor

[57] ABSTRACT

Abrasive liquid detergent compositions containing an anionic surfactant, a nonionic surfactant and a water-insoluble abrasive are disclosed.

14 Claims, No Drawings

LIQUID DETERGENT COMPOSITION CONTAINS ABRASIVE PARTICLES, ANIONIC AND NONIONIC SURFACTANTS

This application is a continuation of application Ser. No. 291,867, filed Aug. 10, 1981, now abandoned, which is a continuation of application Ser. No. 110,148, filed Jan. 7, 1980, now abandoned.

BACKGROUND

The invention relates to a high sudsing liquid detergent containing specified amounts and types of insoluble abrasives especially useful in the washing of tableware, kitchenware and other hard surfaces.

The use of abrasives in powdered scouring cleansers is well known. Scouring cleansers generally contain a relatively high level of abrasive. When such scouring cleansers are used as adjuncts in the dishwashing process such products provide abrading power to make the removal of cooked, burnt, or dried-on foods on kitchenware easier and more convenient. Recently, liquid scouring cleansers containing water-insoluble abrasives have become available. Such liquid compositions are disclosed in U.S. Pat. Nos. 3,149,078; 3,210,285; 3,210,286; 3,214,380; 3,579,456; 3,623,990; 3,677,954; 3,813,349; 3,966,432; and 4,129,527; and British Pat. Nos. 1,384,244 and 1,534,680. The use of scouring cleansers, however, is normally in addition to a specific dishwashing product, one product being required for removal of non-sticking soils, especially fats and oils, and a second product being required for scouring purposes. Canadian Pat. No. 1,048,365 discloses granular detergent compositions suitable for dishwashing containing 20% to 35% surfactant and 5% to 20% of abrasive material having a particle diameter in the range of 200 to 850 microns. Copending commonly assigned U.S. Ser. No. 1,631 of Mitchell et al filed Jan. 8, 1979, discloses liquid detergent compositions suitable for dishwashing containing insoluble abrasives and detergency builders. Copending commonly assigned U.S. Ser. No. 053,162 of Tuthill et al filed June 29, 1979 discloses abrasive-containing liquid detergent compositions in combination with non-clogging dispensing packages. The above applications and patents are incorporated herein by reference.

It is an object of the present invention to provide liquid detergent compositions containing a surfactant and an abrasive, the detergent composition being highly effective in removing food soils from kitchenware when used undiluted or in the form of a relatively concentrated water slurry, but which is highly acceptable for hand dishwashing in the dilute water solutions typically used with liquid dishwashing products.

SUMMARY OF THE INVENTION

The present invention comprises a liquid detergent composition containing by weight:

(a) from about 15% to about 50% of an anionic surfactant;

(b) from about 2% to about 15% of a suds stabilizing nonionic surfactant selected from the group consisting of amine oxides, amides, and the ethylene oxide condensates of alcohols and alkyl phenols;

(c) from about 1% to about 20% of a water-insoluble abrasive having a particle diameter of from about 5 to about 250 microns and a hardness on the Mohs scale of from about 2 to about 8; and (d) from about 20% to about 82% water said composition providing an initial suds cover to a dishwashing solution and a suds cover after the washing of eight plates when used at a concentration of 0.07% in two gallons of 115° F. water containing 7 grains/gallons water hardness measured as $CaCO_3$, each plate carrying 4.0 ml. of triglyceride-containing soil.

The relatively low level of abrasive and high sudsing relative to typical liquid scouring cleanser compositions are important to consumer acceptance and safety to dishes. The level and type of surfactants and the resultant sudsing characteristics appear to provide a protective effect that minimizes damage due to abrasion.

DETAILED DESCRIPTION OF THE INVENTION

The detergent compositions of the present invention contain four essential components:

(a) an anionic surfactant (b) a suds stabilizing nonionic surfactant (c) a water-insoluble abrasive (d) water.

Optional ingredients can be added to provide various performance and aesthetic characteristics.

Anionic Surfactant

The compositions of this invention contain from about 15% to about 50% of an anionic surfactant or mixtures thereof. Preferred compositions for use as a complete dishwashing product contain from about 20% to about 35% of anionic surfactant by weight of the composition.

Most anionic detergents can be broadly described as the water-soluble salts, particularly the alkali metal, alkaline earth metal, ammonium and amine salts, of organic sulfuric reaction products having in their molecular structure an alkyl radical containing from about 8 to about 22 carbon atoms and a radical selected from the group consisting of sulfonic acid and sulfuric acid ester radicals. Included in the term alkyl is the alkyl portion of high acyl radicals. Examples of the anionic synthetic detergents which can form the surfactant component of the compositions of the present invention are the sodium, ammonium or potassium alkyl sulfates, especially those obtained by sulfating the higher alcohols ($C_8$–$C_{18}$ carbon atoms) sodium or potassium alkyl benzene or alkyl toluene sulfonates, in which the alkyl group contains from about 9 to about 15 carbon atoms, the alkyl radical being either a straight or branched aliphatic chain; sodium or potassium paraffin sulfonates and olefin sulfonates in which the alkyl or alkenyl group contains from about 10 to about 20 carbon atoms; sodium allkyl glyceryl ether sulfonates, especially those ethers of the higher alcohols derived from tallow and coconut oil; sodium coconut oil fatty acid monoglyceride sulfates and sulfonates; sodium or potassium salts of alkyl phenol ethylene oxide ether sulfates with about 1 to about 30 units of ethylene oxide per molecule and in which the alkyl radicals contain from 8 to about 12 carbon atoms; the reaction products of fatty acids esterified with isethionic acid and neutralized with sodium hydroxide where, for example, the fatty acids are derived from coconut oil; sodium or potassium salts of fatty acid amides of a methyl tauride in which the fatty acids, for example, are derived from coconut oil and sodium or potassium beta-acetoxy- or beta-acetamido-alkanesulfonates where the alkane has from 8 to 22 carbon atoms.

Specific examples of alkyl sulfate salts which can be employed in the instant detergent compositions include sodium lauryl alkyl sulfate, sodium stearyl alkyl sulfate, sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, potassium coconut alkyl sulfate magnesium $C_{12-15}$ alkyl sulfate and mixtures of these surfactants. Preferred alkyl sulfates include sodium coconut alkyl sulfate, potassium coconut alkyl sulfate, potassium lauryl alkyl sulfate and sodium lauryl alkyl sulfate.

Suitable alkylbenzene or alkyltoluene sulfonates include the alkali metal (lithium, sodium, potassium), alkaline earth (calcium, magnesium) and alkanolamine salts of straight- or branched-chain alkylbenzene or alkyltoluene sulfonic acid. Alkylbenzene sulfonic acids useful as precursors for these surfactants include decyl benzene sulfonic acid, undecyl benzene sulfonic acid, dodecyl benzene sulfonic acid, tridecyl benzene sulfonic acid, tetrapropylene benzene sulfonic acid. Preferred sulfonic acids as precursors of the alkyl-benzene sulfonates useful for compositions herein are those in which the alkyl chain is linear and averages about 12 carbon atoms in length. Examples of commercially available alkyl benzene sulfonic acids useful in the present invention include Conoco SA 515 and SA 597 marketed by the Continental Oil Company and Calsoft LAS 99 marketed by the Pilot Chemical Company.

Particularly preferred anionic surfactants useful herein are alkyl ether sulfates having the formula $RO(C_2H_4O)_xSO_3M$ wherein R is alkyl or alkenyl of about 10 to about 20 carbon atoms, x is 1 to 30, and M is a water-soluble cation. The alkyl ether sulfates useful in the present invention are condensation products of ethylene oxide and monohydric alcohols having from about 10 to about 20 carbon atoms. Preferably, R has 10 to 16 carbon atoms. The alcohols can be derived from natural fats, e.g., coconut oil or tallow, or can be synthetic. Such alcohols are reacted with 1 to 30, and especially 1 to 12, molar proportions of ethylene oxide and the resulting mixture of molecular species is sulfated and neutralized.

Specific examples of alkyl ether sulfates of the present invention are sodium coconut alkyl triethylene glycol ether sulfate, magnesium tallow alkyl triethylene glycol ether sulfate, and sodium tallow alkyl hexaoxy ethylene sulfate. Preferred alkyl ether sulfates are those comprising a mixture of individual compounds, said mixture having an average alkyl chain length of from about 12 to 16 carbon atoms and an average degree of ethoxylation of from about 1 to 12 moles of ethylene oxide.

Additional examples of anionic surfactants useful herein are the compounds which contain two anionic functional groups. These are referred to as di-anionic surfactants. Suitable dianionic surfactants are the disulfonates, disulfates, or mixtures thereof which may be represented by the following formula:

$$R(SO_3)_2M_2, R(SO_4)_2M_2, R(SO_3)(SO_4)M_2$$

where R is an acyclic aliphatic hydrocarbyl group having 15 to 20 carbon atoms and M is a water-solubilizing cation, for example, the $C_{15}$ to $C_{20}$ disodium 1,2-alkyldisulfates, $C_{15}$ to $C_{20}$ dipotassium-1,2-alkyldisulfonates or disulfates, disodium 1,9-hexadecyl disulfates, $C_{15}$ to $C_{20}$ disodium 1,2-alkyldisulfonates, disodium 1,9-stearyldisulfates and 6,10-octadecyldisulfates.

Nonionic Surfactant

The compositions of this invention contain from about 2% to about 15%, preferably from about 3% to about 8% of a suds stabilizing nonionic surfactant or mixtures thereof. The presence of this component is essential to satisfactory performance and acceptance as a complete dishwashing product. In preferred embodiments the nonionic surfactants will be in a weight ratio to the anionic surfactants of from about 1:10 to about 1:2, most preferably from about 1:7 to about 1:3.

Nonionic surfactants operable in the instant compositions are of three basic types—the ethylene oxide condensates, the amides, and the amine oxide semi-polar nonionics.

The ethylene oxide condensates are broadly defined as compounds produced by the condensation of ethylene oxide groups (hydrophilic in nature) with an organic hydrophobic compound, which can be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

Examples of such ethylene oxide condensates include:

(1) The condensation products of aliphatic alcohols with ethylene oxide. The alkyl chain of the aliphatic alcohol can either be straight or branched and generally contains from about 10 to about 14 carbon atoms for best performance as suds stabilizers. Examples of such ethoxylated alcohols include the condensation product of about 6 moles of ethylene oxide with 1 mole of tridecanol, myristyl alcohol condensed with about 10 moles of ethylene oxide per mole of myristyl alcohol, the condensation product of ethylene oxide with coconut fatty alcohol wherein the coconut alcohol is a mixture of fatty alcohols with alkyl chains varying from 10 to 14 carbon atoms and wherein the condensate contains about 6 moles of ethylene oxide per mole of alcohol, and the condensation product of about 9 moles of ethylene oxide with the above-described coconut alcohol. An example of a commercially available nonionic surfactant of this type includes Neodol 23-6.5 marketed by the Shell Chemical Company.

(2) The ethylene oxide condensates of alkyl phenols. These compounds include the condensation products of alkyl phenols having an alkyl group containing from about 6 to 12 carbon atoms in either a straight chain or branched chain configuration, with ethylene oxide, the ethylene oxide being present in amounts equal to 5 to 25 moles of ethylene oxide per mole of alkyl phenol. The alkyl substituent in such compounds can be derived, for example, from polymerized propylene, diisobutylene, octene, or nonene. Examples of compounds of this type include nonyl phenol condensed with about 9.5 moles of ethylene oxide per mole of nonyl phenol, dodecyl phenol condensed with about 12 moles of ethylene oxide per mole of phenol, dinonyl phenol condensed with about 15 moles of ethylene oxide per mole of phenol, diisooctylphenol condensed with about 15 moles of ethylene oxide per mole of phenol. Commercially available nonionic surfactants of this type include Igepal CO-610 marketed by the GAF Corporation; and Triton X-45, X-114, X-100 and X-102, all marketed by the Rohm and Haas Company.

Examples of the amide type of nonionic surface active agent include the ammonia, monoethanol and diethanol amides of fatty acids having an acyl moiety of from about 8 to about 18 carbon atoms. These acyl moieties may be derived from naturally occurring glycerides, e.g., coconut oil, palm oil, soybean oil and tallow, but can be derived synthetically, e.g., by the oxidation of petroleum, or by hydrogenation of carbon monoxide by the Fischer-Tropsch process. The monoethanol amides and diethanolamides of $C_{12-14}$ fatty acids are preferred.

Amine oxide semi-polar nonionic surface active agents comprise compounds and mixtures of compounds having the formula:

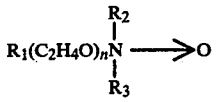

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are methyl, ethyl, propyl, isopropyl, 2-hydroxyethyl, 2-hydroxypropyl, or 3-hydroxy-propyl and n is from 0 to about 10. Particularly preferred are amine oxides of the formula:

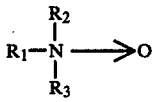

wherein $R_1$ is a $C_{10-14}$ alkyl and $R_2$ and $R_3$ are methyl or ethyl.

The level and type of surfactants used in the compositions of this invention provide an initial suds cover to a dishwashing solution and a suds cover after the washing of 8 plates when used at a concentration of 0.07% in 2 gallons of 115° F. water containing 7 grains/gallon water hardness measured as $CaCO_3$, each plate carrying 4.0 ml of a triglyceride containing soil. Suds are generated by agitation and the suds cover and height measured. A dinner plate carrying the soil is washed successively with the introduction of 4.0 ml of soil each time. An essentially complete suds cover of the washing solution is more important than suds height, but, preferably, the suds cover after the washing of 8 plates is at least about ½ inch in height.

The sudsing characteristic of the compositions of the invention is that necessary to provide the user of the product with an indication of cleaning potential in a dishwashing solution. Soilds encountered in dishwashing act as suds depressants and the presence or absence of suds from the surface of a dishwashing solution is a convenient guide to product usage. Mixtures of anionic surfactants and nonionic surfactants, especially amides and amine oxide nonionic surfactants, are utilized in the compositions of the invention because of their high sudsing characteristics, their suds stability in the presence of food soils and their ability to indicate accurately an adequate level of product usage in the presence of soil.

Optional Surfactants

The compositions of the invention may contain optional surfactants other than anionic and nonionic surfactants such an ampholytic, zwitterionic and cationic surfactants.

Ampholytic surfactants can be broadly described as derivatives of aliphatic amines which contain a long chain of about 8 to 18 carbon atoms and an anionic water-solubilizing group, e.g. carboxy, sulfo or sulfate. Examples of compounds falling within this definition are sodium-3-dodecylamino propane sulfonate, and dodecyl dimethylammonium hexanoate.

Zwitterionic surface active agents operable in the instant composition are broadly described as internally-neutralized derivatives of aliphatic quaternary ammonium and phosphonium and tertiary sulfonium compounds in which the aliphatic radical can be straight chain or branched, and wherein one of the aliphatic substituents contains from about 8 to 18 carbon atoms and one contains an anionic water solubilizing group, e.g., carboxy, sulfo, sulfato, phosphato, or phosphono.

Cationic surfactants such as quaternary ammonium compounds can find optional use in the practice of the invention to the extent they are compatible with the other surfactants in the particular composition.

Abrasive

The abrasive agent can be any of the water-insoluble abrasive materials known in the art which have a particle diameter of from about 5 to about 250, preferably from about 20 to about 125, microns and a hardness on the Mohs scale of from about 2 to about 8, preferable from about 4 to about 7. Included are materials such as agate, mica, calcite, garnet, quartz, kieselguhr, silica, marble, tripoli, flint, feldspar, emery, pumice, alumina, perlite, expanded perlite, volcanic ash, diatomaceous earth, bentonite, amorphous silica from dehydrated silica gels, precipitated silica, plastics such as polystyrene and polyacrylates, and natural and synthetic aluminosilicates and mixtures thereof.

The amount of abrasive included in the compositions is in the range of from about 1% to about 20% of the total composition by weight. Preferred compositions contain from about 3% to about 12% by weight of abrasive.

Water

The compositions of this invention contain from about 20% to about 82%, preferably from about 40% to about 75%, water.

Optional Ingredients

The compositions of this invention can contain up to about 20%, preferably from about 5% to about 15%, by weight of detergency builders either of the organic or inorganic types. Examples of water-soluble inorganic builders which can be used, alone or in admixture with themselves and organic alkaline sequestrant builder salts, are alkali metal carbonates, polyphosphates, and silicates. Specific examples of such salts are sodium tripolyphosphate, sodium carbonate, potassium carbonate, sodium pyrophosphate, potassium pyrophosphate, potassium tripolyphosphate, and sodium hexametaphosphate. Examples of organic builder salts which can be used alone, or in admixture with each other or with the preceding inorganic alkaline builder salts, are alkali metal polycarboxylates, e.g., water-soluble citrates such as sodium and potassium citrate, sodium and potassium tartrate, sodium and potassium ethylenediaminetetraacetate, sodium and potassium N-(2-hydroxyethyl)-ethylene diamine triacetates, sodium and potassium nitrilo triacetates (NTA) and sodium and potassium N-(2-hydroxyethyl)-nitrilo diacetates. Other organic builder salts include the alkali metal salts of phytic acid, e.g., sodium phytate (see U.S. Pat. No. 2,739,942). Water-soluble salts of ethane-1-hydroxy-1,1-diphosphonate (EHDP) are also suitable. Mixtures of any of the preceding water-soluble organic or inorganic builder salts can be used.

The compositions of this invention can contain insoluble builder salts selected from certain zeolites or aluminosilicates. One such aluminosilicate which is useful in the compositions of the invention is water-insoluble crystalline aluminosilicate ion exchange material of the formula:

$$Na_z[(AlO_2)_z\cdot(SiO_2)_y]\cdot xH_2O$$

wherein z and y are at least 6, the molar ratio of z to y is from 1.0 to 0.5 and x is from 10 to 264, said material having a particle size diameter of from about 0.1 micron to about 10 microns, a calcium ion exchange capacity of at least about 200 mg. $CaCO_3$ eq./gram and a calcium ion exchange rate of at least about 2 grains $Ca^{++}$/gallon/minute/gram. This ion exchange builder is more fully described in Belgian Pat. No. 814,874 issued on Nov. 12, 1974 to Corkill et al, herein incorporated by reference. A preferred aluminosilicate of this type is Zeolite A.

A second water-insoluble aluminosilicate ion exchange material useful herein is water-insoluble amorphous hydrated aluminosilicate material of the emperical formula:

$$M_z(zAlO_2\cdot ySiO_2)$$

wherein M is sodium, potassium, ammonium, or substituted ammonium, z is from about 0.5 to about 2, y is 1 and said material having a particle size diameter of less than 100, preferably less than 10, microns, a magnesium ion exchange capacity of at least about 50 milligrms equivalent of $CaCO_3$ hardness per gram of anhydrous aluminosilicate and a $Mg^{++}$ exchange rate of at least about 1 grain/gallon/minute/gram/gallon; and mixtures thereof. This ion exchange builder is more fully described in Gedge et al's French Pat. No. 2,237,839 published Feb. 14, 1975, herein incorporated by reference.

Alcohols, such as ethyl alcohol, and hydrotropes, such as sodium and potassium toluene sulfonate, sodium and potassium xylene sulfonate, trisodium sulfosuccinate and related compounds (as disclosed in U.S. Pat. No. 3,915,903, incorporated herein by reference) and urea, can be utilized in the interests of achieving a desired product phase stability, viscosity, and yield value. Ethyl alcohol at a level of from about 8% to about 12% and potassium or sodium sulfosuccinate at a level of from about 2% to about 5% are particularly useful in the compositions of the invention.

Also particularly useful in the compositions of this invention are suspending or thickening agents such as those disclosed in U.S. Pat. No. 3,393,153 incorporated herein by reference including colloidal silica having a mean particle diameter ranging from about 0.01 micron to about 0.05 micron, colloidal clays such as bentonites or chemically treated bentonites, isomorphous silicates, especially those with a high magnesium content, particulate polymers such as polystyrene, oxidized polystyrene having an acid number of from 20 to about 40, sulfonated polystyrene having an acid number of from about 10 to about 30, polyethylene, oxidized polyethylene having an acid number of from about 10 to about 30; sulfonated polyethylene having an acid number of from about 5 to about 25; polypropylene, oxidized polypropylene having an acid number of from about 10 to about 30 and sulfonated polypropylene having an acid number of from about 5 to about 25, all of said particulate polymers having mean particle diameters ranging from about 0.01 micron to about 30 microns. Other examples of suspending and thickening agents include copolymers of styrene with monomers such as maleic anhydride, nitrilonitrile, methacrylic acid and lower alkyl esters of methacrylic acid, copolymers of styrene with methyl or ethyl acrylate, methyl or ethyl maleate, vinyl acetate, acrylic, maleic or fumaric acids and mixtures thereof. The mole ratio of ester and/or acid to styrene is preferably in the range from about 4 to about 40 styrene units per ester and/or acid unit. Such materials preferably have a mean particle diameter range of from about 0.05 micron to about 1 micron and molecular weights ranging from about 500,000 to about 2,000,000. Cellulosic polymers such as carboxymethyl cellulose and hydroxypropyl cellulose and gums such as guar gum and gum tragacanth are also suitable suspending and thickening agents.

Colloidal clays are especially preferred suspending and thickening agents and provide particularly stable compositions when product pH is maintained or adjusted to a range of from about 8.0 to about 10.0, preferably from about 8.0 to about 9.0. An alkaline pH value has an additional benefit as an aid to cleaning, particularly when the product is used undiluted for scouring purposes.

The detergent compositions of this invention can contain, if desired, any of the usual adjuvants, diluents and additives, for example, perfumes, enzymes, dyes, antitarnishing agents, antimicrobial agents, and the like, without detracting from the advantageous properties of the compositions. Alkalinity sources and pH buffering agents such as alkali metal carbonates and bicarbonates, monoethanolamine, triethanolamine and alkali metal hydroxides can also be utilized.

The presence of at least about 0.5% by weight potassium ions can be beneficial to the physical characteristics of the compositions.

Physical Characteristics of the Detergent Composition

The liquid detergent compositions of the invention contain abrasives as suspended solids and may contain other solid or liquid ingredients that provide desired product stability characteristics and that affect product viscosity. In general, the preferred products of the invention are thixotropic or pseudoplastic and resistant to settling out of the abrasive or other solids yet sufficiently fluid for dispensing. In general, the compositions have a Brookfield viscosity of from about 400 cps to about 2500 cps when measured at 50 rpm and a yield value of from about 5 to about 600 dynes per square centimeter at 25° C.

The important physical property consideration of the preferred compositions of the invention is their yield value. The consistency of simple or Newtonian liquids is a function of the nature of the material, temperature, and pressure only. This consistency is known as the "fluid viscosity coefficient," "absolute viscosity," or merely "viscosity," and is usually measured in centipoises (1 centipoise=0.01 gram/centimeter-second). With a Newtonian liquid, any force applied to the system produces some deformation, according to the formula $du/dr=F/\mu$ where $du/dr$=the rate of shear; F=the shear stress, or shearing force per unit area; and $\mu$=the viscosity coefficient.

In the case of non-Newtonian liquids, on the other hand, the consistency is a function of the material, pressure, temperature, and also the shear stress applied to the system. Those non-Newtonian liquids which are classified as Bingham plastics, or real plastics, are not always deformed when a force is applied to the system. Deformation, if any, takes place according to the formula $du/dr=(F-\int)/\mu_a$ where $\mu_a$=the apparent viscosity, or plastic viscosity, at the shear stress F; $\int$=a characteristic of the liquid called the yield stress, or yield value, measured in units of pressure; and $du/dr$ and F are as defined above.

If the shear stress applied to the system is less than the yield value, the system will not be deformed at all. Hence a Bingham plastic system is capable of supporting indefinitely insoluble particulate material which has a density greater than that of the supporting medium, so long as the material has such a particle size and density that the shear stress which each particle places on the supporting medium does not exceed the yield value.

This is to be contrasted with suspension of heavy insoluble particulate material in Newtonian liquids with high viscosities. In highly viscous Newtonian liquids, insoluble particulate material is suspended only because the rate of flow is slow. In Bingham plastics, insoluble particulate material is suspended because the stress imposed by the particles does not exceed the yield value of the liquid, and therefore, there is no flow at all. Of course, if the yield value of the supporting medium should sufficiently decrease for any reason, the particles would no longer be suspended. This could be caused, for example, by a physical or chemical change in the supporting medium. If one of the components of the supporting medium is an emulsion which settles into layers upon standing, the yield value can be lost temporarily, but in such a case, the original composition can be reconstituted by mixing. If a chemical reaction either consume a vital component or produces a damaging one, the loss of yield value can be permanent.

Because it is usually not known whether a system behaves in a truly plastic manner at low shear rates, the measurement of exact yield values is estimated, in dynes per square centimeter, by the following relationship:

$$\text{Yield Value} = \frac{\text{Viscosity at 0.5 } r.p.m. - \text{Viscosity at 1 } r.p.m.}{100}$$

This relationship represents an extrapolation of the sheer curve to 0 r.p.m. since an absolute shear stress cannot be measured at 0 r.p.m.

The yield value of the liquid detergent compositions of this invention ranges from about 5 to about 600 dynes per square centimeter. If the yield value is too low, the insoluble, particulate material will not be suspended, because the weight of the individual particles, distributed over the area which supports the particles, will exceed the yield value. However, if the yield value is too great, the composition will become thick and unmanageable because as the yield value increases, so will the apparent viscosity.

A preferred range of yield values to support the insoluble particulate material used in the liquid detergent compositions of this invention is from about 100 to about 400 dynes per square centimeter, most preferably from about 200 to about 300 dynes per square centimeter.

As an alternative, compositions containing abrasives having a density approximating that of the detergent composition can be relatively stable without having the preferred yield values.

The following examples are given to illustrate the detergent compositions of the invention. All amounts and percentages are by weight unless otherwise indicated.

EXAMPLES

Liquid detergent compositions of the invention were prepared containing the ingredients listed below:

| | A | B | C | D | E |
|---|---|---|---|---|---|
| Sodium $C_{12-13}$ alkyl Sulfate | 11.5% | 11.5% | 11.5% | 11.5% | 11.5% |
| Sodium $C_{12-13}$ alkyl ethoxy (3) sulfate | 12.5 | 12.5 | 12.5 | 12.2 | 12.5 |
| $C_{12-14}$alkyl dimethyl amine oxide | 4.0 | 4.0 | 4.0 | 4.0 | — |
| $C_{12-14}$alkyl monoethanolamide | — | — | — | — | 6.0 |
| Trisodium sulfosuccinate | 2.0 | 2.0 | 2.0 | 3.0 | 3.0 |
| Calcite (avg. diameter = 125 microns - Moh's Hardness = 3) | — | 10.0 | — | — | — |
| Diatomaceous earth (avg. diameter = 40 microns - Moh's Hardness = 5-7) | 5.0 | — | — | 5.0 | 5.0 |
| Silica (43-105 micron diameter - Moh's Hardness = 7 | — | — | 5.0 | — | — |
| Bentonite clay suspending agent) | 2.5 | 2.5 | — | 2.2 | 2.2 |
| Fumed silica suspending agent) | — | — | 2.0 | — | — |
| Ethanol | 10.0 | 10.0 | 10.0 | 10.0 | 10.0 |
| Water and micellaneous | | | Balance | | |
| Viscosity (Brookfield-50 rpm cps | 1200-1800 cps | 1200-1800 cps | 1200-1800 cps | 1200-1800 cps | 1200-1800 |
| Yield Value (dynes/cm$^2$) | 250 | 250 | 250 | 250 | 250 |

All compositions listed above contain approximately 45 to 55% water and have a pH value in the range of 8.0 to 10.0.

The compositions are entirely satisfactory when used in dilute solutions as a dishwashing detergent compositions and are substantially superior to typical liquid dishwashing detergent compositions when used undiluted or in concentrated solution for removal of tightly attached soils.

Equivalent results are obtained when $C_{12}$ alkyldiethanolamide and the reaction product of a $C_{12-15}$ alcohol and 8 moles of ethylene oxide are substituted for the $C_{12}$ alkyl-monoethanol-amide of Composition E.

Equivalent results are obtained when sodium $C_{12-13}$ alkylbenzene sulfonate and $C_{12-15}$ paraffin sulfonate are substituted for the sodium $C_{12-13}$ alkyl sulfate of compositions A, B, C, D and E.

What is claimed is:

1. A liquid dishwashing detergent composition comprising by weight:

(a) from about 20% to about 35% of an anionic surfactant;

(b) from about 2% to about 8% of a suds stabilizing nonionic surfactant selected from the group consisting of amine oxides and amides;

(c) from about 1% to about 20% of a water-insoluble abrasive having a particle diameter of from about 5 to 250 microns and a hardness on the Mohs scale of from about 2 to about 8; and (d) from about 40% to about 75% water;

said composition providing an initial suds cover to a dishwashing solution and a suds cover after the washing of eight plates when used at a concentration of 0.07% in two gallons of 115° F. water containing 7 grains/gallon water hardness measured as $CaCO_3$, each plate carrying 4.0 ml. of triglyceride-containing soil.

2. The composition of claim 1 wherein the anionic surfactant comprises a material selected from the group consisting of alkyl sulfates, alkyl ether sulfates, alkylbenzene sulfonates, paraffin sulfonates, olefin sulfonates and mixtures thereof.

3. The composition of claim 2 wherein the suds stabilizing nonionic surfactant comprises a material selected from the group consisting of monoethanol and diethanol amides of $C_{12}$–$C_{14}$ fatty acids, $C_{10}$–$C_{14}$ alkyl dimethyl and diethyl amine oxides and mixtures thereof.

4. The composition of claim 3 wherein the abrasive comprises a material selected from the group consisting of quartz, silica, diatomaceous earth, feldspar, high density perlite, calcite and mixtures thereof.

5. The composition of claim 1 wherein the pH value of a 10% solution in water is from about 8.0 to about 10.0.

6. The composition of claim 4 wherein the pH value of a 10% solution in water is from about 8.0 to about 9.0.

7. The composition of claim 1 which comprises a suspending and thickening agent selected from the group consisting of colloidal clays, colloidal silica, isomorphous silicates, and mixtures thereof.

8. The composition of claim 7 wherein the suspending and thickening agent is a colloidal clay.

9. The composition of claim 1 which comprises ethanol.

10. The composition of claim 1 which comprises a suspending and thickening agent and which has a yield value of from about 5 dynes per square centimeter to about 400 dynes per square centimeter.

11. A composition according to claim 3 comprising from about 3% to about 12% of a water-insoluble abrasive having a particle diameter of from about 5 to about 125 microns and a hardness on the Mohs scale of from about 4 to about 7.

12. A composition according to claim 11 wherein the abrasive is a silica having a hardness on the Mohs scale of about 7.

13. A composition according to claim 12 comprising about 5% of the silica.

14. A composition according to claim 13 comprising about 11.5% of sodium $C_{12}$–$C_{13}$ alkyl sulfate, about 12.5% of sodium $C_{12}$–$C_{13}$ alkyl ethoxy (3) sulfate, and about 4.0% of $C_{12}$–$C_{14}$ alkyl dimethyl amine oxide.

* * * * *